US006387218B1

(12) United States Patent
Graf

(10) Patent No.: US 6,387,218 B1
(45) Date of Patent: May 14, 2002

(54) AIR PRESS SEAL IN PAPER-MAKING MACHINE

(75) Inventor: Edwin X. Graf, Menasha, WI (US)

(73) Assignee: Voith Paper, Inc., Appleton, WI (US)

( * ) Notice: Subject to any disclaimer, the term of this patent is extended or adjusted under 35 U.S.C. 154(b) by 0 days.

(21) Appl. No.: 09/702,016

(22) Filed: Oct. 30, 2000

(51) Int. Cl.[7] ..... D21F 3/06
(52) U.S. Cl. ..... 162/358.3; 162/205; 100/156
(58) Field of Search ..... 162/204, 205, 162/206, 109, 111, 117, 274, 358.1, 358.2, 358.3, 358.4, 358.5, 359.1, 360.2, 360.3, 361; 277/300, 306; 100/121, 151, 156

(56) References Cited

U.S. PATENT DOCUMENTS 3,853,698 A * 12/1974 Mohr ..... 162/358.3
3,974,026 A * 8/1976 Emson et al. ..... 162/358.3
4,468,287 A * 8/1984 Dahl ..... 162/358.3
4,568,423 A * 2/1986 Laapotti ..... 162/358.3

* cited by examiner

*Primary Examiner*—Peter Chin
*Assistant Examiner*—Eric Hug
(74) *Attorney, Agent, or Firm*—Taylor & Aust, P.C.

(57) ABSTRACT

A seal used in an air press for dewatering a traveling paper web in a paper-making machine includes a support roll having a cylindrical surface, a belt and felt for supporting the paper web on either side thereof, an arm for mounting the seal, a seal body having a curved outer surface contour for substantially conforming to the curve of the cylindrical surface of the support roll, and an inner surface adjacent to the arm. A leading edge surface intersects with the curved outer surface, the leading edge surface defines the initial engagement with the traveling belt when in an operating position. A trailing edge surface intersects with the curved outer surface. The trailing edge surface defines, with the leading edge surface, the upstream and downstream bounds of the extended nip of the curved outer surface contour of the seal body over the support.

14 Claims, 1 Drawing Sheet

AIR PRESS SEAL IN PAPER-MAKING MACHINE

BACKGROUND OF THE INVENTION

1. Field of the Invention

The present invention relates to paper-making machines, and, more particularly, to pressing apparatus in a paper-making machine.

2. Description of the Related Art

In the press section of a paper-making machine, water is typically removed mechanically by passing the paper web through a nip between structural components, such as two rotating rolls. The nascent paper web is carried on a felt for absorbing the water expressed from the paper web as it passes through the nip.

One of the characteristics of a quality paper product is uniformity of caliper in a cross-machine direction of the paper-making machine. Such uniformity of caliper is difficult to obtain, particularly in bulky products, such as tissue and towel grades, due to deflection of machine components caused by gravity.

Rolls of different design, such as control-deflection rolls and plain rolls, deflect different amounts along their lengths extending in a cross-machine direction. A non-uniform gap, or uneven gap loading in the cross-machine direction, will produce undesirable variations in both caliper and moisture in the web passing through on its way to the dryer section. Such variations undesirably affect the processing of the web, such as by requiring costly special profiling downstream of the press section, increasing expensive thermal removal moisture in the dryer section, or slowing the entire paper-making machine.

It is also known to provide an air press within a paper making machine for the purpose of expressing water from the paper web. Pressurized air within an air chamber exerts pressure against the fiber web for pressing moisture from the fiber web. Air presses have not been widely used because it is difficult to maintain pressure within the air chamber as the fiber web travels through the air press at an operating speed.

What is needed in the art is a way of effectively sealing an air press to inhibit air leakage during operation.

SUMMARY OF THE INVENTION

The present invention provides a seal comprising at least a circular contoured outer surface of a hard material for engaging a belt disposed over a paper web which in turn is disposed over a felt carried on the surface of a support roll having a similar circular contoured surface which establishes an extended nip contact between the seal and support roll outer surfaces.

The invention comprises, in one form thereof, a seal for use in an air press for dewatering a traveling paper web in a paper-making machine, the air press including a support roll having a cylindrical surface, a belt and felt for supporting the paper web on either side thereof, an arm for mounting the seal, a seal body having a curved outer surface contour for substantially conforming to the curve of the cylindrical surface of the support roll, and an inner surface adjacent to the arm. A leading edge surface intersects with the curved outer surface, the leading edge surface defining the initial engagement with the traveling belt when in an operating position. A trailing edge surface intersects with the curved outer surface. The trailing edge surface defines, with the leading edge surface, the upstream and downstream bounds of the extended nip of the curved outer surface contour of the seal body over the support.

An advantage of this invention is the provision of a new and efficient cross-machine seal for use in an air press in a paper-making machine.

Another advantage is the provision of a seal for an air press which has a concave outer surface for engaging a traveling belt over a support roll surface.

Still another advantage is the provision of a seal which has at least an outer surface comprising a ceramic material.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
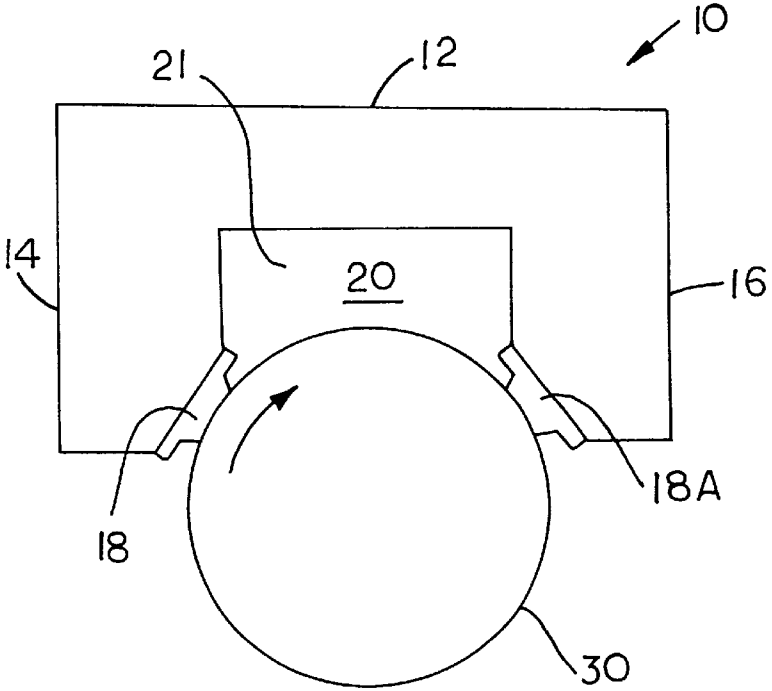
FIG. 1 is a simplified, end view of an air press including a seal in leading and trailing arms of the air press.

Referring now to the drawings, and more particularly to FIG. 1, there is shown an end view of an air press 10 for use in a paper-making machine. Air press 10 includes a frame 12 having a leading arm 14 and trailing arm 16 extending downwardly. At the distal end of each arm 14, 16 is a seal body 18, 18A, respectively. Seals 18 and 18A, in conjunction with frame 12 and the end panels (not shown per se, but designated generally by number 21) define an air chamber 20 for holding pressurized air.

The composite web is comprised of a plurality of separate layered webs. As shown more clearly in FIG. 2, the composite web includes a paper web P, belt B and felt F. In one embodiment, belt B is made of an air-impervious material, such as rubber, or rubberized fabric, which is disposed over the upper surface to bear against the concave outer surface 22 of seals 18, 18A.

Figure 2:
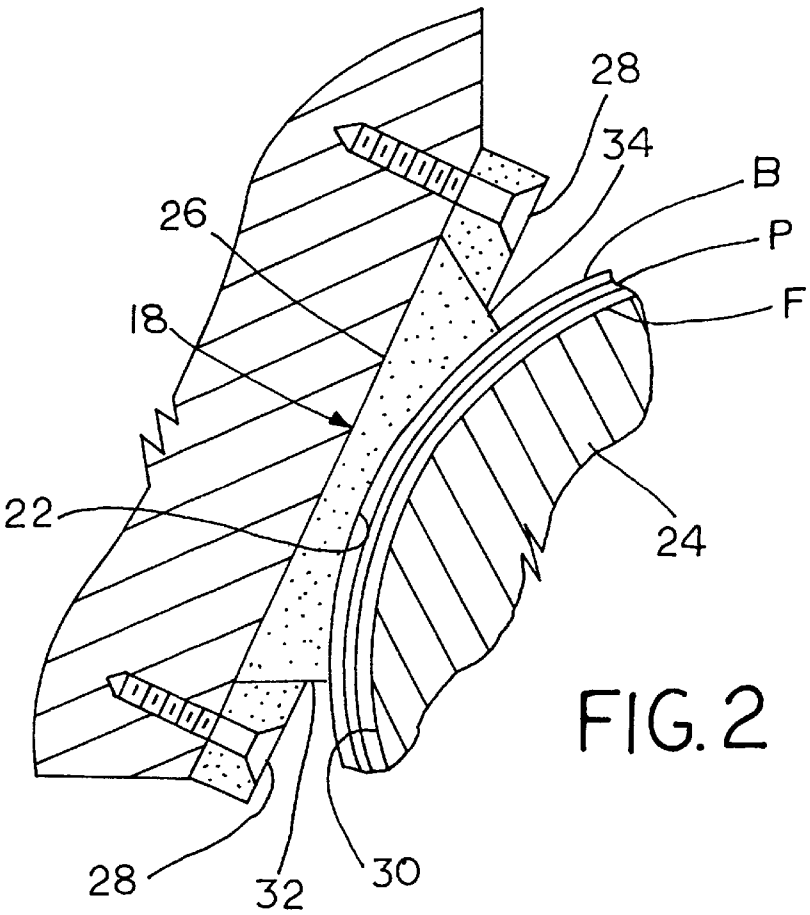
FIG. 2 is an end, sectional view of one of the seals shown in FIG. 1.

With further reference to FIG. 2 in conjunction with FIG. 1, seals 18, 18A have a concave outer surface which is contoured in the form of a concave circular segment to substantially conform with the outer cylindrical face surface 30 of a rotatable backing or support roll 24. Each seal 18, 18A also has a flat inner face 26 which is positioned adjacent to and abuts a respective arm 14, 16. In one embodiment, seals 18, 18A are made of a hard material, such as a ceramic having a polished outer surface 22. Support roll 24 is made of steel with a polished outer surface 30.

Intermediate inner and outer faces 26, 22, respectively, of seal body 18 are leading and trailing edge surfaces 32, 34, respectively. Leading edge surface 32 and trailing edge surface 34 intersect curved outer surface 22 of seal 18 at an angle according to such parameters as the belt material and machine speed. The area on outer surface 22 extending between leading and trailing edge surfaces 32, 34 defines an extended nip when seal body 18 is urged against traveling belt B in operation. Leading and trailing edges 32, 34 serve to bring traveling belt B into air-sealing, sliding engagement with the outer surface 22 of seal body 18, and to define the ending of sliding engagement of belt B with outer surface 22. Clamping bars 36 are attached to a corresponding arm 14, 16 using fasteners 28 and abut a respective leading edge surface 32 and trailing edge surface 34 to attach seals 18, 18A with corresponding arms 14, 16.

It is contemplated that the composite web configuration could be such that belt B could take the form of a felt F, and vice versa, and thus the designations "B" and "F" are purely arbitrary. Further, the composite web configuration could, in certain circumstances, take the form of a paper web P between two felts F. It is contemplated that belt B could be a felt, thereby permitting water expressed from the paper web P to be removed from both the upper and lower sides/faces of paper web P.

In operation, the composite web travels in the extended nip area of contact between concave outer face surface 22 of seal body 18, 18A and cylindrical surface 30 of support roll 24. Travel of the composite web is facilitated by the sliding interface of polished outer surface 22 of seal 18, 18A biased against belt B of the composite web as the composite web is supported with felt F on outer surface 30 of rotating support roll 24. The extended nip at outer surface 22 maintains pressurized air in air chamber 20 by virtue of the interface between the polished curve surface 22 of seal 18, 18A and the rubber/rubberized surface of belt B to fill any small voids which might exist in the extended concave outer surface 22 for the duration of the passage of belt B through the extended nip.

The pressurized air in air chamber 20 presses belt B of composite web. This pressure in turn urges water in paper web P into felt F which is beneath paper web P over outer cylindrical surface 30 of support roll 24. Felt F is in turn dewatered in another portion of its lubed path of travel. This relatively gentle but constant air pressure over a significant segment of outer surface 30 of support roll 24 produces the desired dewatering of paper web P for retaining bulk in paper web P. The extended, curved configuration of seals 18, 18A permits a good seal to be established and maintained regardless of the traveling speed of the paper-making machine and/or air pressure within air chamber 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press assembly in a paper-making machine, comprising:

a support roll having an outside cylindrical surface;

a belt and a felt for supporting the paper web on respective opposite sides thereof, said felt carried by said support roll; and a frame including at least one arm positioned adjacent to said belt, each said arm carrying a respective said seal, each said seal including a seal body having a curved outer surface substantially conforming to said outside cylindrical surface of said support roll, said curved outer surface and said support roll defining an extended nip therebetween, each said seal including an inner surface adjacent said corresponding arm, a leading edge surface extending between said inner surface and said curved outer surface, and a trailing edge surface extending between said inner surface and said curved outer surface, each of said leading edge surface and said trailing edge surface positioned at an acute angle relative to said curved outer surface, said frame and said support roll defining an air chamber therebetween.

2. The press assembly of claim 1, said curved outer surface comprised of a wear-resistant material.

3. The press assembly of claim 2, said curved outer surface comprised of a ceramic material.

4. The press assembly of claim 1, said curved outer surface having a radius of curvature larger than a radius of said support roll.

5. A press assembly in a paper-making machine, comprising:

a support roll having an outside cylindrical surface;

a belt and a felt for supporting the paper web on respective opposite sides thereof, said felt carried by said support roll; and a frame including at least one arm positioned adjacent to said belt, each said arm carrying a respective said seal, each said seal including a seal body having a curved outer surface substantially conforming to said outside cylindrical surface of said support roll, said curved outer surface and said support roll defining an extended nip therebetween, each said seal including an inner surface adjacent said corresponding arm, a leading edge surface extending between said inner surface and said curved outer surface, and a trailing edge surface extending between said inner surface and said curved outer surface, and further including a pair of clamping blocks attached to each said arm, each said pair of clamping blocks respectively engaging said leading edge surface and said trailing edge surface of a corresponding said seal, said frame and said support roll defining an air chamber therebetween.

6. The press assembly of claim 5, each of said leading edge surface and said trailing edge surface positioned at an acute angle relative to said curved outer surface.

7. A paper-making machine, comprising:

a belt and a felt for supporting the paper web on respective opposite sides thereof; and a press assembly, including:

a support roll having an outside cylindrical surface carrying said felt; and a frame including at least two arms positioned adjacent to said belt and at least two end panels extending between said at least two said arms, each said arm carrying a respective seal, each said seal including an inner surface adjacent said corresponding arm, each said seal including a seal body having a curved outer surface substantially conforming to said outside cylindrical surface of said support roll, a leading edge surface extending between said inner surface and said curved outer surface, a trailing edge surface extending between said inner surface and said curved outer surface, each of said leading edge surface and said trailing edge surface positioned at an acute angle relative to said curved outer surface, said curved outer surface defining a concave, substantially circular segment, said curved outer surface and said support roll defining an extended nip therebetween said frame and said support roll defining an air chamber therebetween.

8. The paper-making machine of claim 7, said curved outer surface comprised of a wear-resistant material.

9. The paper-making machine of claim 8, said curved outer surface comprised of a ceramic material.

10. The paper-making machine of claim 7 said curved outer surface having a radius of curvature larger than a radius of said support roll.

11. A paper-making machine comprising;

a belt and a felt for supporting the paper web on respective opposite sides thereof; and a press assembly, including:

a support roll having an outside cylindrical surface carrying said felt; and a frame including at least two arms positioned adjacent to said belt and at least two end panels extending between said at least two said arms, each said arm carrying a respective seal, each said seal including an inner surface adjacent said corresponding arm, each said seal including a seal body having a curved outer surface substantially conforming to said outside cylindrical surface of said support roll, a leading edge surface extending, between said inner surface and said curved outer surface, a trailing edge surface extending between said inner surface and said curved outer surface, said curved outer surface defining a concave, substantially circular segment, said curved outer surface and said support roll defining an extended nip therebetween, said frame and said support roll defining an air chamber therebetween; and a pair of clamping blocks attached to each said arm each said pair of clamping blocks respectively engaging said leading edge surface and said trailing edge surface of a corresponding said seal.

12. The paper-making machine of claim 11, each of said leading edge surface and said trailing edge surface positioned at an acute angle relative to said curved outer surface.

13. A method of operating a press assembly in a paper-making machine, comprising the steps of:

carrying a paper web between a belt and a felt;

providing a press assembly, including:

a support roll having an outside cylindrical surface; and a frame including at least one arm positioned adjacent to said belt, each said arm carrying a respective said seal, each said seal including a seal body having a curved outer surface substantially conforming to said outside cylindrical surface of said support roll, said frame and said support roll defining an air chamber therebetween;

removably attaching each said seal to said corresponding arm, carrying said felt with said support roll; and positioning each said seal adjacent said belt, whereby said air chamber is sealed in an extended press nip between said curved outer surface and said support roll.

14. The method of claim 13, wherein said removably attaching step is carried out using a pair of clamping blocks for each said seal.

* * * * *